US005367745A

United States Patent [19]

Roloff

[11] Patent Number: 5,367,745

[45] Date of Patent: Nov. 29, 1994

[54] HINGE FOR SHOWER STALL DOORS

[76] Inventor: Heinz-Rudolf Roloff, Hüttenallee 101, D-4150 Krefeld, Germany

[21] Appl. No.: 47,745

[22] Filed: Apr. 15, 1993

[30] Foreign Application Priority Data

Apr. 18, 1992 [DE] Germany ..... 9205399[U]

[51] Int. Cl.[5] ..... E05F 1/02

[52] U.S. Cl. ..... 16/312

[58] Field of Search ..... 16/312, 318, 309, 313, 16/314, 315

[56] References Cited

U.S. PATENT DOCUMENTS

| | | | |
|---|---|---|---|
| 412,859 | 10/1889 | Friday | 16/318 |
| 2,362,923 | 11/1944 | Pardoe . | |
| 2,685,103 | 8/1954 | Forkey | 16/318 |
| 5,058,236 | 10/1991 | Henson | 16/222 |
| 5,139,322 | 8/1992 | Aisley | 16/318 |

FOREIGN PATENT DOCUMENTS

| | | |
|---|---|---|
| 0362883 | 10/1989 | European Pat. Off. . |
| 0277513 | 12/1991 | European Pat. Off. . |
| 172151 | 9/1905 | Germany . |
| 2418147 | 11/1975 | Germany . |

*Primary Examiner*—P. Austin Bradley
*Assistant Examiner*—Chuck Y. Mah
*Attorney, Agent, or Firm*—Herbert Dubno

[57] ABSTRACT

A shower stall door hinge has two members connected by a pintle and having axially aligned sleeves. The sleeves of one member with one notch at one end which can be engaged by a radial pin in a radial bore of the pintle. In one of the other sleeves, a radial throughbore is provided to allow an anchoring pin to be inserted to lock that sleeve and its hinge member to the pintle when a fixed rest position for the door is to be defined by engagement of the pin in the notch. In the absence of the stop pin, a pair of washers flank the intermediate sleeve can be provided to allow free swinging of the hinge members.

9 Claims, 2 Drawing Sheets

Fig. 1
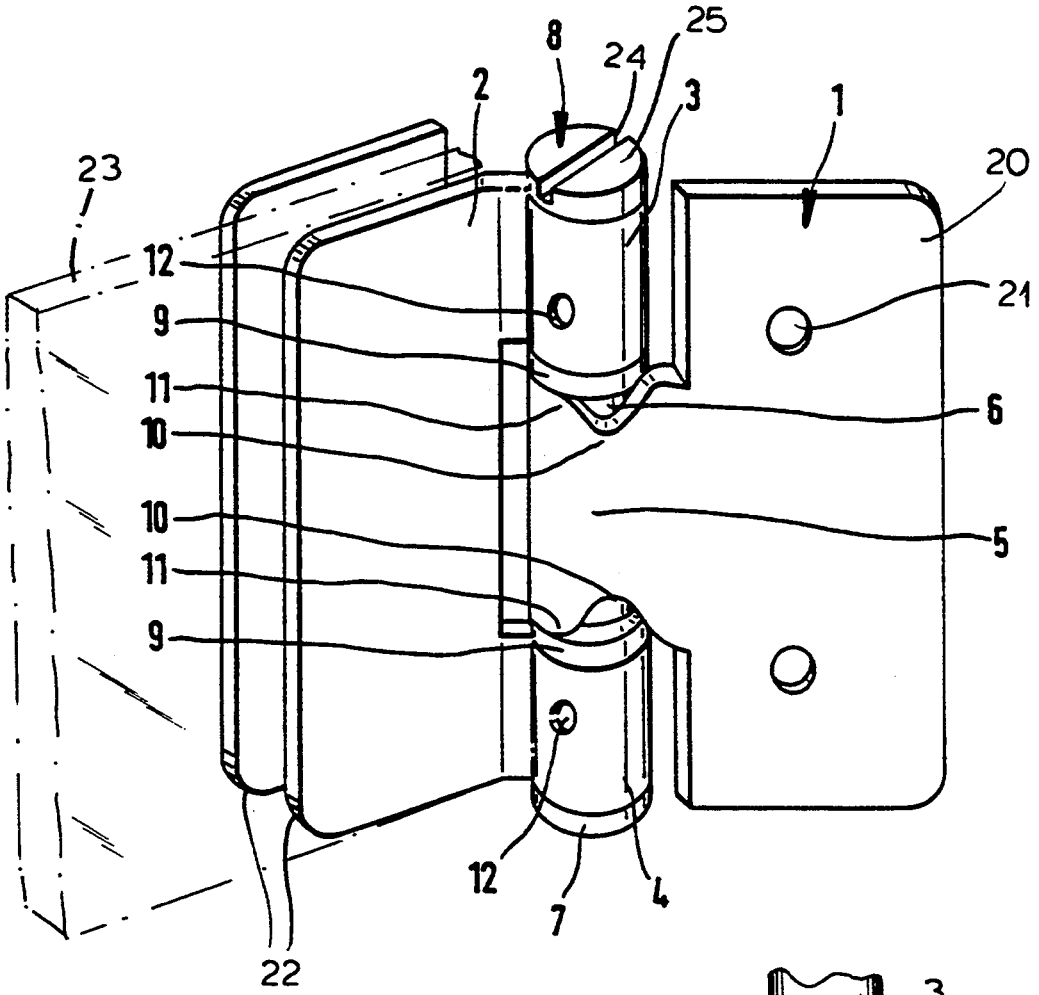
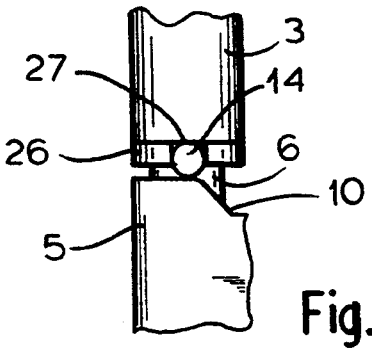
Fig.3

HINGE FOR SHOWER STALL DOORS

FIELD OF THE INVENTION

My present invention relates to a hinge for shower stall doors and, more particularly, to a hinge which can allow free swinging of a shower stall door or can be mounted so as to position the shouer stall door automatically in a fixed relationship to a door frame, wall or the like.

BACKGROUND OF THE INVENTION

A hinge for a shower stall can comprise two hinge members, one of which has a pair of coaxial hinge sleeves between which the hinge sleeves of the other member is disposed, the sleeves being axially aligned and registering with one another and transversed by a hinge pin or pintle.

A hinge of this type is described in EP 02 77 513.

Between the neighboring sleeves in the space between them, a coil spring which surrounds the hinge pin can be disposed and can have its opposite ends affixed to one of the hinge sleeves. As a consequence, when the shower stall door mounted upon one of the hinge members is swung out of a normal rest position, the spring is stressed and automatically biases the door into its rest position.

Usually, therefore, the spring operates to close the door and, since the hinge is originally equipped with the spring on fabrication, the normal rest position into which the spring urges the door is fixed and cannot be altered as may be desired on mounting of the hinge or mounting of the door. In many cases, however, it is desirable to select the rest position of a shower stall door with respect to the hinge of a structure upon which the hinge is mounted.

OBJECTS OF THE INVENTION

It is therefore an object of the present invention to provide an improved hinge, especially for a shower stall door, whereby drawbacks of earlier hinge structures for similar applications are avoided.

Another object of the invention is to provide an improved hinge which allows, optionally based upon the mounting of the hinge, a shower stall door provided with the hinge to swing free or to be arrested in a predetermined position which may be selected at will by the person mounting the door.

Still another object of the invention is to provide a shower stall door hinge of greater versatility than earlier hinges for this purpose and which, in spite of the increased versatility, is of comparatively low cost and high functional reliability.

SUMMARY OF THE INVENTION

These objects and others which will become apparent hereinafter are attained, in accordance with the invention by providing the two sleeves of one of the members, e.g. that which is affixed to the shower stall door, so that their axial spacing is greater than the axial length of the sleeve on the other member received between the first mentioned members, and by forming at least one of the coaxial hinge sleeves of one of the hinge members with a radial throughgoing bore. The hinge sleeve of a hinge sleeve of the other member at at least one of its ends is formed with a notch while the hinge pin, in the space between two neighboring sleeves is formed with a radial bore for a respective stop pin adapted to drop into the aforementioned notch or otherwise to engage therein so that, by gravitational engagement of the stop pin in the notch a predetermined relative angular position of the hinge pin and the member provided with the notch is established, corresponding to the desired rest position of the door.

Utilizing the bore provided in the sleeve of the other member, that sleeve can be anchored to the pin so that a fixed angular positioning of the pin and the latter member is assured.

As a consequence, the hinge can be utilized as a free swinging hinge for a shower stall door by not connecting the sleeve provided with the bore with the hinge pin or by omitting or withdrawing the stop pin from the hinge pin.

To improve the appearance, in this case, of the hinge, the axial spacing between the sleeves of the two members can be filled completely or partially by rings or washers whose axial lengths may be equal to half the length of the axial gap between the sleeves of the two members or equal substantially to half the differences between the spacing of the pair of sleeves of the first hinge member and the axial length of the sleeve of the second hinge member.

These rings or washers may be provided at the factory and may be supplied to the user in place. If, therefore, the hinge is not to operate as a free swinging hinge but is to position the shower stall door at a fixed location, the washers or rings can be removed and the stop pin inserted in the bore in the hinge pin and permitted to drop into or engage in the notch.

Once the hinge is in place, the user can drill through the bore in the sleeve of the first member into the hinge pin with the door positioned in its desired rest position relative to the second hinge member, and a position pin then inserted through this bore and the hole which is made in the hinge pin.

As a consequence, the hinge pin will then be angularly fixed to the first hinge member and will rotate therewith, while the stop pin will engage in the notch when the door is in its desired rest position. The flanks of the notch can be inclined so as always to return the door to the rest position regardless of its position into which the door has been swung, and the flanges can have transitions into rounded edges to facilitate the camming of the pin into the notch.

When the notch is oriented so as to be upwardly open and the pin is to drop by gravity into the notch, upon swinging of the door from the rest position, a flange of the notch will cam the stop pin upwardly and, upon release of the door, the pin will glide back into the notch, returning to its rest position.

On optical grounds, it is advantageous to provide a washer or ring which fills part of the gap between axially aligned sleeves of the two hinge members and formed with a radial slit for partly accommodating the stop pin engaged in the bore of the pintle.

The remaining space between neighboring hinge sleeves is to be reduced.

More particularly, a hinge of the invention can comprise:

a first hinge member having a pair of axially spaced apart aligned sleeves;

a second hinge member having a sleeve aligned with the sleeves of the first hinge member and received therebetween, the sleeves of the first member being axially spaced by a distance greater than an axial length of the sleeve of the first member, one of the members being provided with means for mounting a shower stall door thereon, the other of the members being provided with means for mounting the hinge upon a support;

a pintle extending through the sleeves for relative angular displacement of the members about an axis of the pintle;

a radial throughbore formed in at least one sleeve of one of the members enabling anchoring of the pintle angularly thereto;

a notch formed in an end of one of the sleeves opening into a space between the sleeves of the members along the pintle;

a radial bore formed in the pintle in the space; and a stop pin removably received in the radial bore in the pintle and projecting radially therefrom to engage by gravity in the notch and position the hinge members angularly at a predetermined rest position of the door upon swinging of the door from the rest position.

BRIEF DESCRIPTION OF THE DRAWING

The above and other objects, features and advantages of my invention will become more readily apparent from the following description, reference being made to the accompanying highly diagrammatic drawing in which:

FIG. 1 is a perspective view of a shower stall door hinge as supplied;

FIG. 3 is a fragmentary elevational view showing the presence of a washer with a radial slit partly accommodating the pin.

SPECIFIC DESCRIPTION

Figure 2:
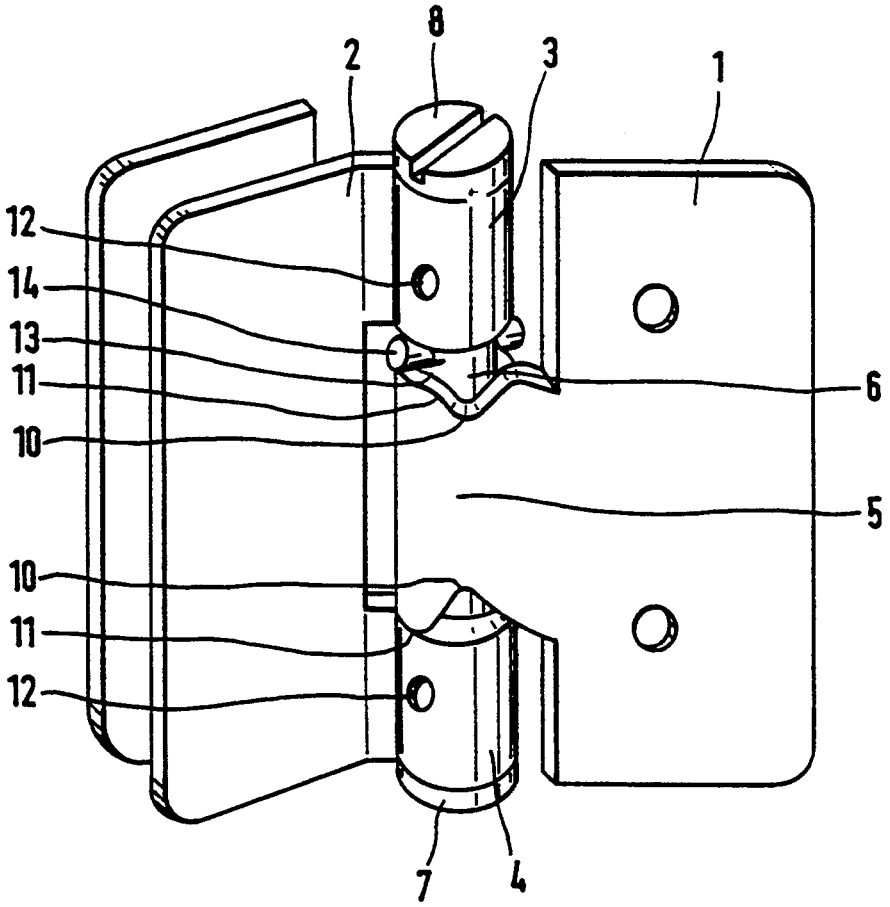
FIG. 2 is a perspective view of the shower stall hinge mounted to provide a fixed rest position for the shower stall door.

The hinge shown in the drawing comprises two hinge members 1 and 2. The hinge member 1, referred to herein as the second hinge member, is provided with a plate 20 having holes 21 allowing the hinge to be mounted on a wall, frame of the shower stall or some other support for the hinge and the door.

The other hinge member 2, referred to herein as the first hinge member can be provided with a pair of plates 22 forming means for mounting a glass door 23 on the hinge.

The hinge member 2 comprises 2 axially spaced apart but coaxial hinge sleeves 3, 4. The hinge member 1 has a single hinge sleeve 5 which is disposed between the sleeves 3, 4. The two hinge members 1, 2 are interconnected by a hinge pin 6 or pintle which passes through the axially aligned and registering hinged sleeves 3, 4, 5. The hinge pin or pintle 6 defines the axis of the hinge about which the glass door 23 can be swung relative to the wall or frame forming the support upon which the door is mounted.

The hinge pin 6 can be removed and, for this purpose, comprises at one end an annular flange 7 or head, while its opposite end is provided with a screw thread (not shown) in which a screw 8 can be engaged. The screw 8 having a slot 24 in its head 25 which forms a stop for the upper end of the sleeve 3. The flange 7 forms a stop for the lower end of the sleeve 4.

The sleeves 3 and 4 are axially spaced by a distance which is greater than the axial length of the sleeve 5. The result is an axial spacing between the sleeves 3, 5 and between the sleeves 4, 5 which, as can be seen in FIG. 1 for the hinge as supplied from the factory, is filled by two rings or washers 9 flush with sleeves 3, 4 and of the same outer diameter and each of which has an axial length of half of the difference between the axial spacing of the sleeves 3, 4 and the axial length of the sleeve 5. The washers each provide a clean appearance for the hinge which can be mounted in the configuration of FIG. 1 if the door 23 is to swing freely and not assume a particular rest position.

The intermediate sleeve 5 has at both of its ends respective notches 10, the flanges of which diverge from the root of the notch and are rounded as represented at 11 so that these flanks form camming surfaces which cam the pin 14 into the bottom of the notch as will be described.

The two outer coaxial sleeves 4 have respective radial throughbores 12.

In an axial gap or space between the sleeves of the two members, the pintle 6 has a radial throughgoing bore 13 in which the stop pin 14 is received or receivable (removably) so that it can project radially and engage in one of the notches 10. While only one notch is shown at each end of the sleeve 5 in FIG. 1, it will be understood that each of these notches can represent a pair of diametrically opposite notches so that the pin 14 can project radially from opposite sides of the pintle 6 and engage in a respective pair of diametrically opposite notches.

If the shower stall door 23 is to be arrested at a given angular position relative to the support (and to the hinge member 1), the pintle 6 is initially removed and the washers 9 extracted.

In the radial bore 13 of the pintle, the stop pin 14 is inserted and the pintle 6 is rotated so that the pin 14 will engage in the notch 10 of the intermediate sleeve 5. Then the door is swung with its hinge member 2 into the desired rest position to which it will in the future return when released.

With a drill, radial bores are pierced in the pintle 6 through one or both of the throughbores 12 of the sleeves 3, 4 and locking pins are then inserted through the bores 12 to angularly lock the pintle 6 with the sleeves 3, 4.

If the shower stall door is then swung out of its rest position, the pintle 6 is rotated with the hinge member 2 and entrains the pin 14.

When the pin 14 engages in the upper notches of the sleeve 5 gravitationally, the swinging of the shower stall door results in a camming of the pin 14 upwardly. When the door is released, the pin 14 falls by the weight of the door into the notch, thereby swinging the door back into its rest position.

By having notches 10 at both ends of the intermediate sleeve 5 and enabling the pintle to be inserted either from the bottom or from the top into the hinge, I am able to provide the hinge for both left and right mounting of the door.

As can be seen from FIG. 3, a washer 26 with a radial slot 27 in which the pin 14 is partly engaged, can be provided in the space between the sleeves of the two members. The axial length of this washer can be dimensioned so that the pin 14 can nevertheless engage in the notch. The washer reduces the visible space between the sleeves.

I claim:

1. A hinge for a shower stall door, comprising:

a first hinge member having a pair of axially spaced apart aligned sleeves;

a second hinge member having a sleeve aligned with said sleeves of said first hinge member and received therebetween, said sleeves of said first member being axially spaced by a distance greater than an axial length of said sleeve of said first member, one of said members being provided with means for mounting a shower stall door thereon, the other of said members being provided with means for mounting said hinge upon a support;

a pintle extending through said sleeves for relative angular displacement of said members about an axis of said pintle;

a radial throughbore formed in at least one sleeve of one of said members enabling anchoring of said pintle angularly thereto;

a notch formed in an end of one of said sleeves opening into a space between said sleeves of said members along said pintle;

a radial bore formed in said pintle in said space; and a stop pin removably received in said radial bore in said pintle and projecting radially therefrom to engage by gravity in said notch and position said hinge members angularly at a predetermined rest position of said door upon swinging of said door from said rest position.

2. The hinge defined in claim 1 wherein said notches are provided on both ends of said sleeve of said second member.

3. The hinge defined in claim 1 wherein said radial bore extends through said pintle.

4. The hinge defined in claim 1, further comprising a washer having a radial slot partly receiving said stop pin in said space.

5. The hinge defined in claim 1 wherein said first member is provided with said means for mounting said shower stall door thereon, one of said sleeves of said first member is provided with said radial throughbore, and said sleeve of said second member is provided with said notch.

6. The hinge defined in claim 5 wherein said notches are provided on both ends of said sleeve of said second member.

7. The hinge defined in claim 6 wherein said radial bore extends through said pintle.

8. The hinge defined in claim 7, further comprising a washer having a radial slot partly receiving said stop pin in said space.

9. A hinge for a shower stall door, comprising:

a first hinge member having a pair of axially spaced apart aligned sleeves;

a second hinge member having a sleeve aligned with said sleeves of said first hinge member and received therebetween, said sleeves of said first member being axially spaced by a distance greater than an axial length of said sleeve of said first member, one of said members being provided with means for mounting a shower stall door thereon, the other of said members being provided with means for mounting said hinge upon a support;

a pintle extending through said sleeves for relative angular displacement of said members about an axis of said pintle.

a radial throughbore formed in at least one sleeve of one of said members enabling anchoring of said pintle angularly thereto;

a notch formed in an end of one of said sleeves opening into a space between said sleeves of said members along said pintle;

a radial bore formed in said pintle in said space capable of receiving a stop pin which can project radially therefrom to engage by gravity in said notch and position said hinge members angularly at a predetermined rest position of said door upon swinging of said door from said rest position; and a pair of removable space-filling washers axially flanking said sleeve of said second member and of axial lengths equal to substantially half an axial difference of said length of said distance and said length of the sleeve of said second member, said washers being removable to allow insertion of said stop pin in said radial bore.

* * * * *